US009510410B2

(12) United States Patent
Teufel et al.

(10) Patent No.: US 9,510,410 B2
(45) Date of Patent: Nov. 29, 2016

(54) ELECTRIC DRIVER CIRCUIT FOR DRIVING A LIGHT-EMITTING DIODE

(71) Applicant: ams AG, Unterpremstaetten (AT)

(72) Inventors: Mario Teufel, Gratwein (AT); Joachim Lechner, Graz (AT)

(73) Assignee: AMS AG, Unterpremstaetten (AT)

( * ) Notice: Subject to any disclaimer, the term of this patent is extended or adjusted under 35 U.S.C. 154(b) by 0 days.

(21) Appl. No.: 14/902,842

(22) PCT Filed: Jun. 18, 2014

(86) PCT No.: PCT/EP2014/062861
§ 371 (c)(1),
(2) Date: Jan. 4, 2016

(87) PCT Pub. No.: WO2015/000703
PCT Pub. Date: Jan. 8, 2015

(65) Prior Publication Data

US 2016/0174312 A1 Jun. 16, 2016

(30) Foreign Application Priority Data

Jul. 5, 2013 (EP) ..... 13175371

(51) Int. Cl.
*H05B 41/28* (2006.01)
*H05B 33/08* (2006.01)

(52) U.S. Cl.
CPC ..... *H05B 33/0818* (2013.01); *H05B 33/0815* (2013.01); *H05B 33/0887* (2013.01)

(58) Field of Classification Search
CPC .... H05B 33/08; H05B 37/029; H05B 41/34; H05B 33/0887; H05B 41/2921; H05B 41/2925; H05B 41/3921
USPC ..... 315/247, 224, 225, 185 S, 291, 307, 326
See application file for complete search history.

(56) References Cited

U.S. PATENT DOCUMENTS

2012/0181942 A1* 7/2012 Redjebian ..... H05B 41/28 315/210
2012/0274228 A1 11/2012 Szczeszynski
2014/0168567 A1* 6/2014 Kikuchi ..... H05B 33/0815 349/61

FOREIGN PATENT DOCUMENTS

EP 02079157 A2 7/2009

* cited by examiner

*Primary Examiner* — Tuyet Vo
(74) *Attorney, Agent, or Firm* — McDermott Will & Emery LLP

(57) ABSTRACT

An electric driver circuit for driving a light-emitting diode may be operated in a regulation operation mode to generate an output voltage to drive a predefined current through the light-emitting diode. The electric driver circuit is operated in a start-up operation mode before the regulation operation mode. The operation of the electric driver circuit in the start-up operation mode enables that a coil current generated in an inductor can be completely discharged before starting the regulation operation mode.

15 Claims, 3 Drawing Sheets

ELECTRIC DRIVER CIRCUIT FOR DRIVING A LIGHT-EMITTING DIODE

TECHNICAL FIELD

The invention is directed to an electric driver circuit for driving a light-emitting diode, for example, a flash-LED-driver to drive a flash LED module. The invention further concerns a method for operating an electric driver circuit for driving a light-emitting diode.

BACKGROUND

For operating an LED (light-emitting diode) a predetermined voltage has to be applied to the LED to drive a defined current through the LED. The voltage is usually generated by an electric driver circuit, such as a flash-LED-driver. The electric driver circuit comprises an input terminal to supply a voltage supply potential. The input terminal may be connected to an electric path comprising an external voltage supply source and an inductor. The electric driver circuit may comprise a first output terminal to output a first output voltage and a second output terminal to output a second output voltage. The electric driver circuit may comprise a current sink/source being connected between the first and second output terminal. A capacitor may be connected to the first output terminal. The second output terminal may be connected to the LED.

The electric driver circuit may be configured as a boost converter which is activated to provide the predetermined voltage for operating the light-emitting diode, when the voltage on the current sink/source between the first and second output terminal drops below a certain voltage, for example 200 mV. When the electric driver circuit is operated in the activated state, the output voltage at the second output terminal is regulated to a predetermined value to drive a predefined current through the light-emitting diode. The electric driver circuit is activated, for example, when the voltage generated by the external voltage supply source falls below a threshold value caused, for example, due to a discharge of a battery coupled to the input terminal of the electric driver circuit.

Assuming that the current through the light-emitting diode is slowly ramped up, it can happen that the electric driver circuit has to be activated at very low LED-current, but it can also happen that the electric driver circuit has to be activated at a very high load. This depends on the charge/discharge state of the external voltage supply source, for example a battery, the generated voltage at the second output terminal, the series resistance of the battery, the series resistance of the inductor or other inherent resistors of the electric driver circuit inside a housing of a chip including the electric driver circuit.

After being activated to regulate the output voltage at the second output terminal to the predetermined value, during a first cycle of a regulation operation mode of the electric driver circuit, a first current path of the electric driver circuit in which a current flows from the external voltage supply source through the inductor/coil to a reference potential of the electric driver circuit is activated. During a subsequent second cycle of the regulation operation mode of the electric driver circuit, the first current path is deactivated and a second current path is activated in which the current flows from the inductor to the first output terminal of the driver circuit to charge the external capacitor.

When the output voltage at the first output terminal is at the same level as the voltage of the voltage supply source coupled to the input terminal of the electric driver circuit, the current/energy which was generated in the inductor within the first cycle of the regulation operation mode cannot be discharged within the second cycle of the regulation operation mode to the external capacitor connected to the first output terminal. This causes a huge coil current peak in the inductor, and therefore a huge battery current peak. These current peaks may cause unexpected shutdown of mobile devices including the light-emitting diode, such as a flash LED module, due to the high battery current consumption. Therefore, such peaks of current in the inductor have to be avoided, especially in high current flash-LED-drivers.

It is desirable to provide an electric driver circuit for driving a light-emitting diode in which the occurrence of a huge coil current peak or a huge battery current peak during a regulation operation mode of the electric driver circuit to generate a predetermined output voltage to drive a predefined current through a light-emitting diode may be avoided. There is also a need to provide a method for operating an electric driver circuit for driving a light-emitting diode which enables to avoid a huge coil current peak/huge battery current peak during a regulation operation mode of the electric driver circuit to generate a predetermined output voltage to drive a predefined current through the light-emitting diode.

SUMMARY

An electric driver circuit for driving a light-emitting diode is specified in claim 1. According to an embodiment of an electric driver circuit for driving a light-emitting diode, the electric driver circuit comprises an input terminal to supply an input current to the driver circuit, a first output terminal to output a first output voltage, a second output terminal to output a second output voltage and to connect the light emitting diode. The driver circuit further comprises a controllable switch having a control terminal to apply a first control signal to switch the first controllable switch in one of a conductive and non-conductive state, wherein the controllable switch is coupled between the input terminal and a node of the driver circuit to apply a reference signal. The driver circuit also comprises a current source to generate a current at the second output terminal. The current source is connected between the first output terminal and the second output terminal. The driver circuit comprises a control circuit to generate the first control signal, and a comparator circuit which is configured to compare the first output voltage with the second output voltage. The control circuit and the controllable switch are configured such that the controllable switch is operated in a non-conductive state, if the control circuit generates the first control signal with a first level and the controllable switch is operated in a conductive state, if the control circuit generates the first control signal with a second level being different form the first level. The control circuit is configured to generate the first control signal only with the first level, when the comparator circuit detects that the difference between the first and second output voltage is above a threshold value or identical with the threshold value. The control circuit is configured to generate the first and second level of the first control signal such that, during a first period of time, first consecutive sequences of at least one alternating first and second level of the first control signal including at least one second level of the first control signal are generated, wherein the at least one second level of the first control signal is generated in each of the consecutive first sequences for a constant time, and, during a second period of time following the first period of time, second consecutive sequences of the first and second level of the first control signal are generated, wherein the second level of the first control signal is generated in at least two of the second sequences of the first and second level of the first control signal with a variable time, when the comparator circuit detects that the difference between the first and second output voltage is below the threshold value.

That means that, during the first period of time, the first control signal commutes between the first and second level, wherein the second level of the first control signal is generated during the first period of time for a constant time. During the second period of time following the first period of time, the first control signal commutes between the first and second level, wherein the second level of the first control signal is generated during the second period of time with a variable time, when the comparator circuit detects that the difference between the first and second output voltage is below the threshold value.

A method for operating an electric driver circuit for driving a light-emitting diode is specified in claim 13. According to an embodiment of the method for operating an electric driver circuit for driving a light-emitting diode, the electric driver circuit as described above is provided. A voltage supply source and an inductor are connected to the input terminal of the electric driver circuit. A capacitor is connected to the first output terminal of the electric driver circuit. A light-emitting diode is connected to the second output terminal of the electric driver circuit. The first output voltage is compared with the second output voltage. The first control signal is generated only with the first level, when the difference between the first and second output voltage is above a threshold value or identical with the threshold value. The first control signal is generated with the first and second level, when the difference between the first and second output voltage is below the threshold value. During a first period of time first consecutive sequences of at least one alternating first and second level of the first control signal are generated, wherein the at least one second level of the first control signal is generated in each of the consecutive first sequences for a constant time. During a second period of time following the first period of time, second consecutive sequences of the first and second level of the first control signal are generated, wherein the second level of the first control signal is generated in at least two of the second sequences of the first and second level of the first control signal with a variable time, when the difference of the first and second output voltage is below the threshold value.

DETAILED DESCRIPTION

Figure 1:
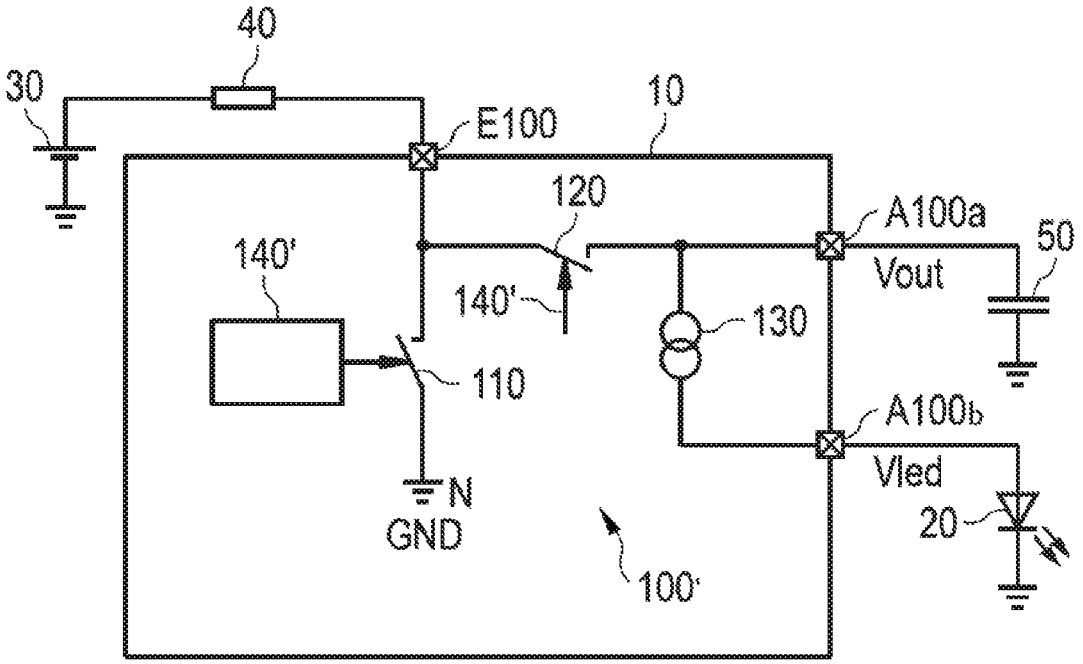
FIG. 1 shows an embodiment of a chip comprising an electric driver circuit for driving a light-emitting diode.

FIG. 1 shows an embodiment of a chip 10 including an electric driver circuit 100' for driving a light-emitting diode 20. The driver circuit 100' comprises an input terminal E100 to supply an input current/supply voltage to the driver circuit. The input terminal E100 may be connected to an electric path comprising a voltage supply source 30, such as a battery, and an inductor/coil 40. The driver circuit further comprises an output terminal A100*a* to output an output voltage Vout and an output terminal A100*b* to output an output voltage Vled. A capacitor 50 may be connected to the first output terminal A100*a*, and at least one light-emitting diode 20 may be coupled to the output terminal A100*b*. The light-emitting diode 20 may be part of a flash LED module. A current source 130 of the electric driver circuit is coupled between the output terminal A100*a* and the output terminal A100*b*. The electric driver circuit 100' comprises a first current path including a controllable switch 110 and a second current path including another controllable switch 120. The controllable switches 110 and 120 may be controlled by a control circuit 140'. The control circuit 140' may switch the controllable switches 110 and 120 in one of a conductive and non-conductive state.

The electric driver circuit 100' may be configured as a boost converter which may be activated to regulate the output voltage Vled at the output terminal A100*b* to a predetermined value to drive a predefined current through the LED 20. The boost converter is configured to generate a boosted output voltage Vled, if the voltage supplied by the voltage supply source 30 falls below a threshold level.

During the regulation operation mode of the electric driver circuit to regulate the output voltage Vled to the predetermined value, the control circuit 140' of the driver circuit 100' switches the controllable switch 110 in a conductive state and the controllable switch 120 in a non-conductive state during a first cycle of the regulation operation mode. As a result, a current flows from the voltage supply source 30 through the inductor 40 and the controllable switch 110 to a node N to apply a reference potential GND. During the first cycle of the regulation operation mode energy is stored in the inductor 40.

During a second cycle of the regulation operation mode the controllable switch 110 is switched by the control circuit 140 to the non-conductive state and the controllable switch 120 is switched by the control circuit 140 to the conductive state. The energy stored in the inductor 40 during the first cycle of the regulation operation mode should be handed over to the output capacitor 50 during the second cycle of the regulation operation mode.

Assuming that before the regulation operation mode starts, the controllable switch 110 is operated in the non-conductive state and the controllable switch 120 is operated in the conductive state, the voltage of the voltage supply source 30 is nearly equal to the output voltage Vout provided at the output terminal A100*a*. When the controllable switch 110 is switched by the control circuit 140' in the conductive state, and the controllable switch 120 is switched in the non-conductive state during the first cycle of the regulation operation mode, energy is stored in the inductor 40.

When the controllable switch 110 is then switched in the non-conductive state and the controllable switch 120 is switched in the conductive state during the second cycle of the regulation operation mode, the energy which was generated in the inductor 40 during the first cycle of the regulation operation mode cannot be discharged within the second cycle of the regulation operation mode, because the output voltage Vout is nearly equal to the voltage of the voltage supply source 30. As a result, a huge coil current peak and therefore a huge battery current peak occurs which may cause an unexpected shutdown of the electric driver circuit. Such an unexpected shutdown may especially occur in mobile devices comprising a flash-LED-driver in the configuration as shown in FIG. 1 to drive a flash LED module due to the high battery current consumption.

Figure 2:
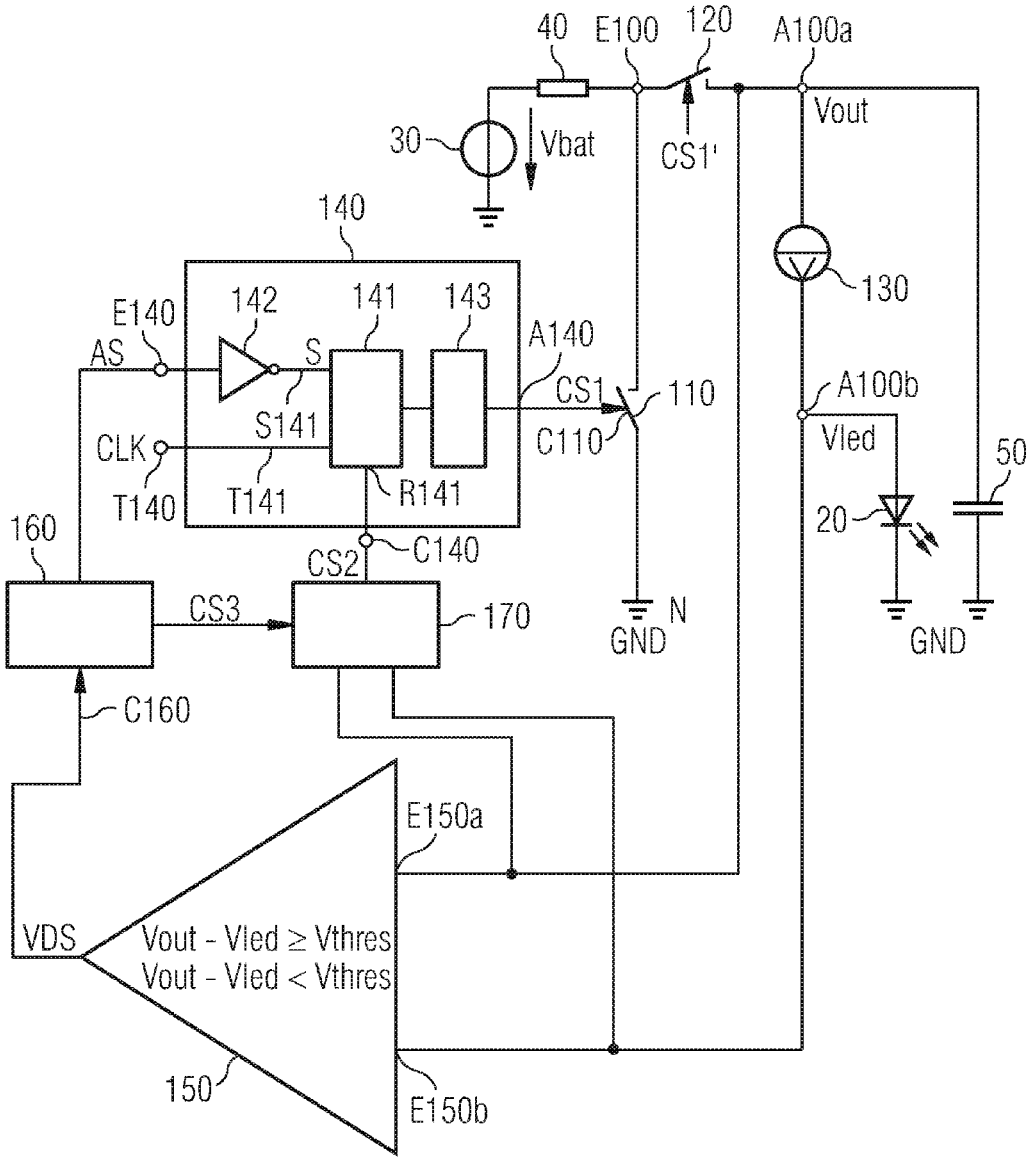
FIG. 2 shows an embodiment of an electric driver circuit for driving a light-emitting diode.

FIG. 2 shows an embodiment of an electric driver circuit 100 for driving a light-emitting diode 20. The light-emitting diode 20 can be part of an LED module, such as a flash LED module of a mobile device, for example a mobile phone or a digital camera. The electric driver circuit 100 comprises an input terminal E100 to supply an input current to the electric driver circuit, an output terminal A100*a* to output an output voltage Vout, and an output terminal A100*b* to output an output voltage Vled. The input terminal E100 is configured to be connected to a current path comprising a voltage supply source 30 and an inductor 40. The output terminal A100*a* to output the output voltage Vout is configured to be connected to an external capacitor 50. The output terminal A100*b* to output the output voltage Vled is configured to be connected to the light-emitting diode 20.

The electric driver circuit 100 further comprises a controllable switch 110 and a controllable switch 120. The controllable switch 110 is coupled between the input terminal E100 and a node N of the driver circuit 100 to apply a reference potential GND, such as the ground potential. The controllable switch 110 has a control terminal C110 to apply a control signal CS1 to switch the controllable switch 110 in one of a conductive and non-conductive state. The control signal CS1 may be generated by a control circuit 140 of the electric driver circuit 100. The controllable switch 120 is arranged between the input terminal E100 and the output terminal A100*a* of the electric driver circuit 100. The controllable switch 120 is configured to be switched in one of a conductive and non-conductive state by applying a control signal CS1'. The control signal CS1' may be generated by the control circuit 140.

The control circuit 140 and the controllable switch 110 are configured such that the controllable switch 110 is operated in the non-conductive state, if the control circuit 140 generates the control signal CS1 with a first level, for example a low-level. The control circuit 140 and the controllable switch 110 are further configured such that the controllable switch 110 is operated in the conductive state, if the control circuit 140 generates the control signal CS1 with a second level being different from the first level. The second level may be a high voltage level.

The controllable switch 120 may be inversely controlled to the controlling of the controllable switch 120. The control circuit 140 is configured to operate the controllable switch 110 in the conductive state, if the controllable switch 120 is operated in the non-conductive state, and to operate the controllable switch 110 in the non-conductive state, if the controllable switch 120 is operated in the conductive state.

Each of the controllable switches 110 and 120 may be configured as a transistor having a respective gate terminal to apply the control signals CS1, CS1'. In an alternative embodiment a Schottky diode may be arranged between the input terminal E100 and the output terminal A100*a* of the electric driver circuit 100.

The electric driver circuit 100 further comprises a current source 130 to generate a current at the output terminal A100*b*. The current source 130 is arranged between the output terminal A100*a* and the output terminal A100*b*. The electric driver circuit further comprises a comparator circuit 150 which is configured to compare the output voltage Vout with the output voltage Vled and to generate a comparison signal VDS in dependence on the comparison of the levels of the output voltages Vled and Vout. An input side of the comparator circuit 150 is connected to the output terminal A100*a* and the output terminal A100*b* such that a first input terminal E150*a* of the comparator circuit is connected to the output terminal A100*a* of the electric driver circuit 100 and an input terminal E150*b* of the comparator circuit 150 is connected to the output terminal A100*b* of the electric driver circuit 100.

The electric driver circuit may further comprise an activation circuit 160 to generate an activation signal AS and a control signal CS3 in dependence on the comparison signal VDS. The activation signal AS is applied to an activation terminal E140 of the control circuit 140. The electric driver circuit 100 further comprises a regulator circuit 170 to generate a control signal CS2. The control signal CS3 is applied to the regulator circuit 170. The regulator circuit 170 is configured to generate the control signal CS2 in dependence on the control signal CS3 and the output voltages Vout and Vled. The regulator circuit 170 is coupled to the output terminal A100*a* to receive the output voltage Vout and the output terminal A100*b* to receive the output voltage Vled.

The control circuit 140 comprises a clock terminal T140 to apply a clock signal clk, the activation terminal E140 to apply the activation signal AS, a control terminal C140 to apply the control signal CS2 and an output terminal A140 to generate the control signal CS1. The control circuit 140 comprises a flip-flop circuit 141 having a clock terminal T141 being coupled with the clock terminal T140 of the control circuit 140, a set terminal 5141 being coupled with the activation terminal A140 of the control circuit 140, and a reset terminal R141 being coupled with the control terminal C140 of the control circuit 140. In the embodiment of the control circuit 140 shown in FIG. 2, an inverter 142 is arranged between the activation terminal E140 of the control circuit 140 and the set terminal 5141 of the flip-flop circuit 141. A driver circuit 143 is coupled between the flip-flop circuit 141 and the output terminal A140 of the control circuit 140 which is connected to the control terminal C110 of the controllable switch 110.

Figure 3:
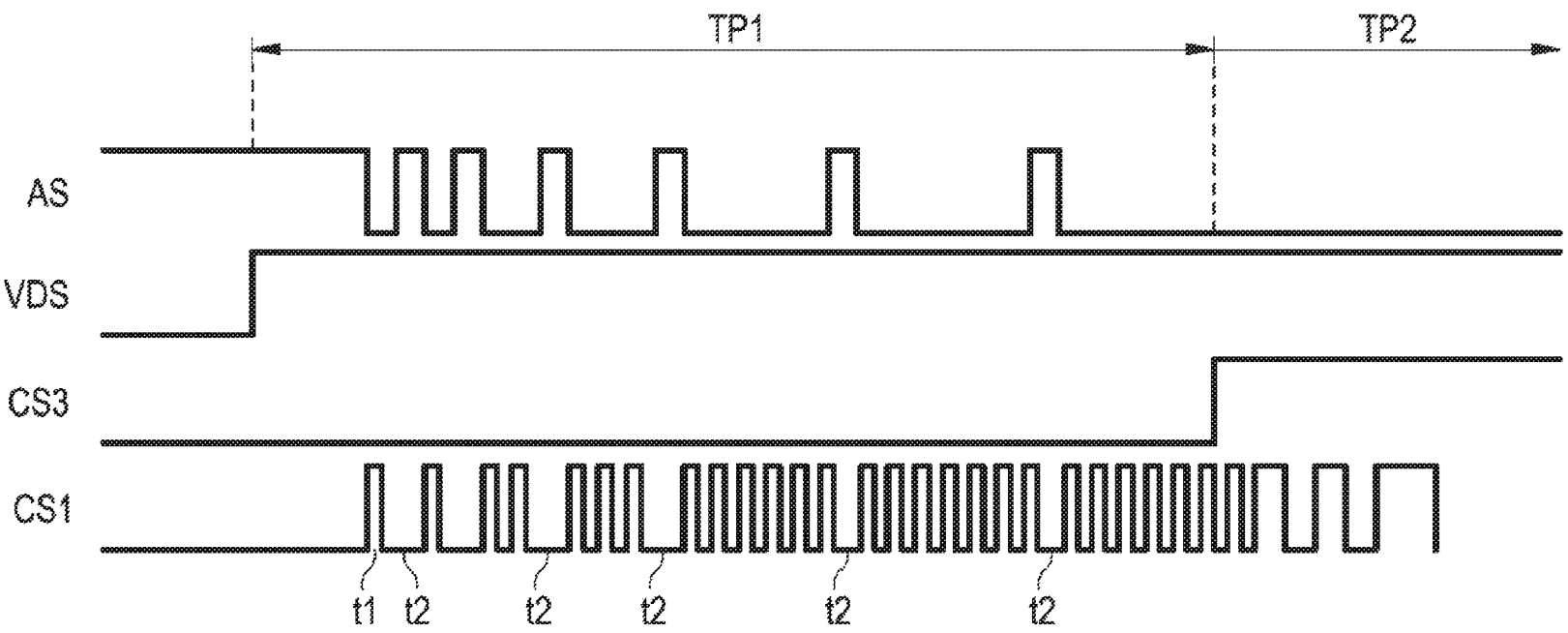
FIG. 3 shows a diagram with signal sequences of signals generated in the electric driver circuit for driving a light-emitting diode.

The function of the components of the electric driver circuit 100 are described in the following with reference to FIG. 2 and the diagrams of FIG. 3 showing a course of the activation signal AS, the comparison signal VDS, the control signal CS3 and the control signal CS1.

The control circuit 140 is configured to generate the control signal CS1 only with the first level, for example the low voltage level, when the comparator circuit 150 detects that the difference between the output voltage Vout and Vled is above a threshold value Vthres or is identical to the threshold value Vthres. In this case the control circuit 140 controls the controllable switch 120 in the conductive state so that the voltage Vout has the same level as a voltage Vbat of the voltage supply source 30. This corresponds to an operation state of the electric driver circuit, when the voltage level of the voltage supply source 30 is sufficiently high to provide the output voltage Vled with a predetermined voltage level to drive a predefined current through the light-emitting diode 20.

The control circuit 140 is further configured to generate the first and second level of the control signal CS1 such that, during a first period of time TP1 in a start-up operation mode of the electric driver circuit before entering the regulation operation mode during a second period of time, first consecutive sequences of at least one alternating first and second level of the first control signal CS1 are generated, wherein the at least one second level, for example the high voltage level of the control signal CS1, is generated in each of the first consecutive sequences for a constant time, when the comparator circuit 150 detects that the difference between the output voltages Vout and Vled is below the threshold value Vthres. The control circuit 140 is further configured to generate second sequences of the first and second level of the control signal CS1 such that, during a second period of time TP2 in which the driver circuit is operated in the regulation operation mode and which follows the first period of time TP1, i.e. the start-up operation mode, the second level, for example the high voltage level, of the control signal CS1 is generated in at least two of the second sequences of the first and second level of the control signal CS1 with a variable time, when the comparator circuit 150 detects that the difference between the output voltage Vout and Vled is below the threshold value Vthres.

The comparator circuit 150 detects that the difference between the output voltage Vout and Vled is below the threshold value Vthres, for example, when the voltage supply source 30, for example an external battery, is discharged to an amount which is not any more sufficient to provide the output voltage Vled with a level being sufficiently high to drive the predefined current through the light-emitting diode 20.

The control circuit 140 is configured to generate the first sequences of the at least one alternating first and second level of the control signal CS1 during the start-up operation mode of the driver circuit such that in each of the first sequences including at least two second levels, for example two high levels, of the control signal CS1, the first level, for example the low level, of the control signal CS1 is generated between the at least two second levels of the control signal CS1 for a first time t1. The control circuit 140 is further configured to generate the first sequences of the at least one alternating first and second level of the control signal CS1 such that the first level of the control signal CS1 is generated between each of the first sequences of the at least one alternating first and second level of the control signal CS1 for a second time t2 being larger than the first time t1.

According to another embodiment the control circuit 140 is configured to generate each of the first sequences of the at least one alternating first and second level of the control signal CS1 following a prior one of the first sequences of the at least one alternating first and second level of the control signal CS1 with an increased number of the second levels, for example the high voltage levels, of the control signal CS1 in comparison to the number of the second levels of the control signal CS1 included in the prior one of the first sequences of the at least one alternating first and second level of the control signal CS1.

The control circuit 140 is configured to be selectively operated in an activated and deactivated state in dependence on the activation signal AS. The control circuit 140 is configured to generate one of the first and second level of the control signal CS1 in dependence on a state of the clock signal clk and the control signal CS2, when the control circuit 140 is operated in the activated state. The control circuit 140 is further configured to generate the control signal CS1 with the first level, for example the low voltage level, in dependence on the state of the clock signal clk and the state of the control signal CS2, when the control circuit 140 is operated in the deactivated state.

According to the embodiment of the control circuit 140 including the flip-flop circuit 141, the flip-flop circuit 141 may be selectively operated in the activated and deactivated state in dependence on a set signal S which is dependent from the activation signal AS. In the activated state, the flip-flop circuit 141 is configured to generate one of the first and second level, i.e. the low and high voltage level, of the control signal CS1 in dependence on a state of the clock signal clk and the control signal CS2, for example a reset signal applied to the reset terminal R141 of the flip-flop circuit 141. In the deactivated state, the flip-flop circuit 141 is configured to generate the control signal CS1 only with the first level, for example the low voltage level, independent of the state of the clock signal clk and the reset signal CS2.

The activation circuit 160 is configured to generate the activation signal AS with a first and a second level, for example a low and a high voltage level. The control circuit 140 is configured to be operated in the activated state, when the activation signal AS is applied at the activation terminal E140 of the control signal 140 with the first level, for example the low voltage level, of the activation signal AS. The control circuit 140 is further configured to be operated in the deactivated state, when the activation signal AS is applied to the activation terminal E140 with the second level, for example the high voltage level, of the activation signal AS.

The comparator circuit 150 generates the comparison signal VDS in dependence on the comparison of the output voltages Vout and Vled. The activation circuit 160 may be switched between an active and inactive state in dependence on the comparison signal VDS applied to its control terminal C160. In the activated state, the activation circuit 160 is configured to generated the activation signal AS with an alternate sequence of the first and second level, for example a low and high voltage level, during the first period of time TP1 in the start-up operation mode before the regulation operation mode. The activation circuit 160 is further configured to generate the activation signal AS only with the first level, for example the low voltage level, during the second period of time TP2 in the regulation operation mode following the first period of time TP1, when the activation circuit 160 is operated in the active state.

In the active state, the activation circuit 160 is further configured to generate the alternate sequence of the first and second level of the activation signal AS such that the time during which the activation signal AS is generated with the first level, for example, the low voltage level, is increased from the beginning of the period of time TP1 in the start-up operation mode of the electric driver circuit until the end of the period of time TP1 at the end of the start-up operation mode, and the time during which the activation signal AS is generated with a second level, for example the high voltage level, is kept constant during the entire period of time TP1, i.e. during the start-up operation mode. The activation circuit 160 is further configured to generate the activation signal AS only with a second level, for example the high voltage level, when the activation circuit 140 is operated in the inactive state.

The electric driver circuit 100 may be used for driving the light-emitting diode 20 with a predefined current. The electric driver circuit 100 may be encapsulated in a chip 10, such as shown in FIG. 1. To this purpose, the at least one light-emitting diode 20, which may be part of an LED module such as a flash LED module, may be connected to the output terminal A100*b* of the electric driver circuit. An external capacitor 50 may be coupled to the output terminal A100*a*, and a voltage supply source 30 and an inductor 40 may be coupled to the input terminal E100 of the electric driver circuit 100.

The electric driver circuit 100 is configured as a boost converter which enables to provide the predetermined output voltage Vled and the predefined current for driving through the LED 20 even if the voltage supply source 30, for example a battery, is discharged to an amount that is no longer sufficient to provide the predefined current for driving the LED 20. The comparator circuit 150 monitors the difference between the output voltage Vout at the output terminal A100*a* and the output voltage Vled at the output terminal A100*b* which is equal to the voltage which drops at the current sink/source 130. When the comparator circuit detects that the difference between the output voltages Vout and Vled is above or identical to a predetermined threshold value Vthres, for example 200 mV, the comparator circuit 150 generates the comparison signal VDS with a first level, for example a low voltage level.

In this case, the predetermined output voltage Vled to drive the predefined current through the LED 20 may be provided by the voltage supply source 30. The activation circuit 160 generates the activation signal AS with the second level, for example the high voltage level and the control signal CS3 with the first level, for example the low voltage level. As a result, the control circuit 140 generates the control signal CS1 with the first level, for example the low voltage level, so that the controllable switch 110 is operated in the non-conductive state and the controllable switch 120 is operated in the conductive state.

If the comparator circuit 150 detects that the difference between the output voltages Vout and Vled is below the predetermined threshold value Vthres, the comparator circuit 150 generates the comparison signal VDS with the second level, for example the high voltage level. In this case, the activation circuit 160 is switched in the active state. In the active state, the activation circuit 160 generates the activation signal AS with the alternate sequence of the first and second level, for example the low and high voltage level, during the first period of time TP1 in the start-up operation mode of the electric driver circuit, and generates the activation signal AS only with the first level, for example the low voltage level, during the second period of TP2 in the regulation operation mode of the electric driver circuit following the first period of time TP1.

The activation circuit 160 generates the alternate sequence of the first and second level of the activation signal AS in its active state such that the time during which the activation signal AS has the first level, for example the low voltage level, is increased from the beginning of the first period of time TP1 until to the end of the first period of time TP1. The second level of the activation signal AS is kept constant by the activation circuit 160 during the first period of time TP1.

The activation circuit 160 generates the control signal CS3 with the first level, for example the low voltage level, from the beginning of the first period of time TP1 until the end of the first period of time TP1. The control signal CS3 is generated with the first level during the entire start-up operation mode of the driver circuit before operating the driver circuit in the regulation operation mode. The activation circuit 160 generates the control signal CS3 with the second level, for example the high voltage level, during the second period of time TP2, i.e. in the regulation operation mode of the driver circuit.

When the voltage across the current source 130 drops below a threshold value, the electric driver circuit 100 is not directly operated in the regulation operation mode to regulate the output voltage Vled to a predetermined value. The electric driver circuit 100 is rather operated during the entire first time period TP1 in the start-up operation mode before the regulation operation mode starts during the second time period TP2. During the start-up operation mode, i.e. during the first time period TP1, the controllable switch 110 is toggled between the conductive and non-conductive state only when the activation signal is generated with the first level, for example the low level. In this state of the activation signal AS, the second level of the control signal CS1, for example the high voltage level, is generated in each of the first consecutive sequences of the at least one alternating first and second level of the control signal CS1 for a constant time.

The control signal CS1 is generated permanently with the first level, for example the low voltage level, when the activation signal is generated with the first level, for example the low voltage level. The time during which the activation signal is generated with the first voltage level is increased by the activation circuit during the start-up operation mode so that the number of changes between the first and second level of the control signal CS1 is increased in the first consecutive sequences of the at least one alternating first and second level of the control signal CS1 from the beginning of the start-up operation mode until the end of the start-up operation mode. This causes the electric driver circuit running through a wide frequency range and enables to discharge the inductor 40 completely during each of the first sequences of the at least one alternating first and second level of the control signal CS1. The energy stored in the inductor 40 can be completely hand over during each of the first sequences of the at least one alternating first and second level of the control signal CS1.

The length of the first period of time TP1, i.e the time duration of the start-up operation mode, may be fixed, for example to 128 ms. When the control signal CS3 is generated with the first level, for example the low voltage level, the regulator circuit 170 resets the flip-flop circuit 141 after a minimum on-time, for example 25 nanoseconds. The controllable switch 110 is switched in the conductive state exactly for this minimum on-time, but no longer. The regulation of the output voltage Vled to a predetermined value to drive the light-emitting diode 20 with a predefined current is disabled during the first period of time TP1, i.e. during the start-up operation mode of the driver circuit 100. The driver circuit 100 is operated in the regulation operation mode to regulate the output voltage Vled to the predetermined value in the second period of time TP2 when the control signal CS3 changes from the first level to the second level, for example the high voltage level.

When the activation circuit 160 generates the control signal CS3 with the second level at the end of the first period of time TP1, the regulator circuit 170 is operated in the regulation operation mode. In the regulation mode, the regulator circuit 170 generates the control signal CS2, for example a reset signal for the flip-flop circuit 141, such that the time during which the controllable switch 110 is switched in the conductive and non-conductive state is changed and adjusted during the second period of time TP2 to generate the output voltage Vled with the predetermined value to drive the predefined current through the light-emitting diode 20. During the second period of time TP2 following the first period of time TP1 the control signal CS1 is generated with the second level for a variable time.

The electric driver circuit 100 for driving an LED 20 enables that battery current peaks of a battery used as a voltage supply source 30 may completely be avoided, even if parameters like the battery voltage Vbat, the output voltage Vled, a series resistance of the battery, a series resistance of the coil or a series resistance of the controllable switches 110, 120 or the configured LED-current are changing over lifetime or from one start-up procedure to another start-up procedure. For this purpose the control circuit 140 generates the control signal CS1 such that clock pulses of the clock signal clk are quasi skipped, particularly at the beginning of the start-up operation mode of the electric driver circuit. By skipping the clock pulses clk it is possible to influence the battery current, for example peaks of the battery current, during the first period of time TP1 before the regulation operation mode starts in the second period of time TP2.

To avoid such overshoots, the activation circuit 160 may be configured as a function generator/digital control circuit, which continuously decreases the duty cycle of the activation signal AS. In particular, this means that the frequency seen by the control circuit 140 to switch the controllable switches 110 and 120 is increased until the nominal frequency of the clock signal clk is reached. This leads to a smooth run through a wide operating frequency range of the control circuit 140 which enables to discharge the coil current through the inductor 40 so that the energy gained during the conductive state of the controllable switch 110 may be completely handed over to the capacitor 50 in the conductive state of the controllable switch 120.

The regulation loop to generate the predetermined output voltage Vled to drive the light-emitting diode 20 with the predefined current is disabled within the first period of time TP1 and enabled when the nominal operating frequency of the control circuit 140 has been reached. This has the advantage that the regulator circuit 170 has to be stable for the nominal frequency of the clock signal clk only. All other analog blocks can be operated at the nominal frequency of the clock signal clk within the whole first period of time TP1 so that it is not necessary to design all blocks of the electric driver circuit for the whole frequency range which is run through during the first time period TP1. The time duration of the first period of time TP1 and the number of implemented frequency steps until the nominal frequency of the clock signal clk is reached can be adjusted.

The invention claimed is:

1. An electric driver circuit for driving a light emitting diode, comprising:

an input terminal to supply an input current to the driver circuit, a first output terminal to output a first output voltage, a second output terminal to output a second output voltage and to connect the light emitting diode, a controllable switch having a control terminal to apply a first control signal to switch the first controllable switch in one of a conductive and non-conductive state, wherein the controllable switch is coupled between the input terminal and a node of the driver circuit to apply a reference signal, a current source to generate a current at the second output terminal, the current source being connected between the first output terminal and the second output terminal, a control circuit to generate the first control signal, a comparator circuit being configured to compare the first output voltage with the second output voltage, wherein the control circuit and the controllable switch are configured such that the controllable switch is operated in a non-conductive state, if the control circuit generates the first control signal with a first level and the controllable switch is operated in a conductive state, if the control circuit generates the first control signal with a second level being different form the first level, wherein the control circuit is configured to generate the first control signal only with the first level, when the comparator circuit detects that the difference between the first and second output voltage is above a threshold value or identical with the threshold value, wherein the control circuit is configured to generate the first and second level of the first control signal such that, during a first periode of time, first consecutive sequences of at least one alternating first and second level of the first control signal including at least one of the second level of the first control signal are generated, wherein the at least one second level of the first control signal is generated in each of the first consecutive sequences for a constant time, and, during a second periode of time following the first periode of time, second consecutive sequences of the first and second level of the first control signal are generated , wherein the second level of the first control signal is generated in at least two of the second sequences of the first and second level of the first control signal with a variable time, when the comparator circuit detects that the difference between the first and second output voltage is below the threshold value.

2. The electric driver circuit as claimed in claim 1, wherein the control circuit is configured to generate the first sequences of the at least one alternating first and second level of the first control signal such that in each of the first sequences including at least two second levels of the first control signal, the first level of the first control signal is generated between the at least two second levels of the first control signal for a first time, wherein the control circuit is configured to generate the first sequences of the at least one alternating first and second level of the first control signal such that the first level of the first control signal is generated between each of the first sequences of the at least one alternating first and second level of the first control signal fora second time being larger than the first time.

3. The electric driver circuit as claimed in claim 1, wherein the control circuit is configured to generate each of the first sequences of the at least one alternating first and second level of the first control signal following a prior one of the first sequences of the at least one alternating first and second level of the first control signal with an increased number of the second levels of the first control signal in comparison to the number of second levels of the first control signal included in the prior one of the first sequences of the at least one alternating first and second level of the first control signal.

4. The electric driver circuit as claimed in claim 1, comprising:

another controllable switch being configured to be switched in one of a conductive and non-conductive state, wherein the other controllable switch is coupled between the input terminal of the electric driver circuit and the first output terminal of the electric driver circuit, wherein the control circuit is configured to switch the controllable switch and the other controllable switch such that the controllable switch is operated in the conductive state, if the other controllable switch is operated in the non-conductive state, and the other controllable switch is operated in the conductive state, if the controllable switch is operated in the non-conductive state.

5. The electric driver circuit as claimed in claim 1, wherein the control circuit comprises a flip-flop circuit having a clock terminal being coupled with the clock terminal of the control circuit, a set terminal being coupled with the activation terminal of the control circuit, and a reset terminal being coupled with the control terminal of the control circuit.

6. A method for operating an electric driver circuit for driving a light emitting diode, comprising:

providing an electric driver circuit as claimed in claim 1, connecting a voltage supply source and an inductor to the input terminal of the electric driver circuit, connecting a capacitor to the first output terminal of the electric driver circuit, connecting a light emitting diode to the second output terminal of the electric driver circuit, comparing the first output voltage with the second output voltage, generating the first control signal only with the first level, when the difference between the first and second output voltage is above a threshold value or identical with the threshold value, generating the first control signal with the first and second level, when the difference between the first and second output voltage is below the threshold value, generating, during a first periode of time, first consecutive sequences of at least one alternating first and second level of the first control signal, wherein the at least one second level of the first control signal is generated in each of the first consecutive sequences for a constant time, and, during a second periode of time following the first periode of time, generating second consecutive sequences of the first and second level of the first control signal, wherein the second level of the first control signal is generated in at least two of the second sequences of the first and second level of the first control signal with a variable time, when the difference of the first and second output voltage is below the threshold value.

7. The method as claimed in claim 6, comprising:

providing the electric driver circuit as claimed in claim 4, switching the controllable switch in the conductive state, if the other controllable switch is operated in the non-conductive state, and switching the other controllable switch in the conductive state, if the controllable switch is operated in the non-conductive state.

8. The method as claimed in claim 6, comprising:

generating the first sequences of the at least one alternating first and second level of the first control signal such that in each of the first sequences including at least two second levels of the first control signal the first level of the first control signal is generated between the at least two second levels of the first control signal for a first time, and the first level of the first control signal is generated between each of the first sequences of the at least one alternating first and second level of the first control signal for a second time being larger than the first time, generating each of the first sequences of the at least one alternating first and second level of the first control signal following a prior one of the first sequences of the at least one alternating first and second level of the first control signal with an increased number of the second levels of the first control signal in comparison to the number of the second levels of the first control signal included in the prior one of the first sequences of the at least one alternating first and second level of the first control signal.

9. The electric driver circuit as claimed in claim 1, comprising:

an activation circuit to generate an activation signal, wherein the control circuit is configured to be selectively operated in an activated and deactivated state in dependence on the activation signal, wherein the control circuit has a clock terminal to apply a clock signal, an activation terminal to apply the activation signal, a control terminal to apply a second control signal and an output terminal to generate the first control signal, wherein, in the activated state, the control circuit is configured to generate one of the first and second level of the first control signal in dependence on a state of the clock signal and the second control signal, wherein, in the deactivated state, the control circuit is configured to generate the first control signal with the first level independent on the state of the clock signal and the second control signal.

10. The electric driver circuit as claimed in claim 9, comprising:

a regulator circuit to generate the second control signal in dependence on a third control signal and the first and second output voltages, wherein the activation circuit is configured to generate a change of a state of the third control signal after the first periode of time.

11. The electric driver circuit as claimed in claim 9, wherein the activation circuit is configured to generate the activation signal with a first and a second level, wherein the control circuit is configured to be operated in the activated state, when the activation signal is applied at the activation terminal of the control circuit with the first level of the activation signal, wherein the control circuit is configured to be operated in the deactivated state, when the activation signal is applied at the activation terminal of the control circuit with the second level of the activation signal.

12. The electric driver circuit as claimed in claim 11, wherein the comparator circuit is configured to generate a comparison signal in dependence on the comparison of the first and second output voltage, wherein the activation circuit has a control terminal to apply the comparison signal to switch the activation circuit between an active and inactive state.

13. The electric driver circuit as claimed in claim 12, wherein, in the active state, the activation circuit is configured to generate the activation signal with an alternate sequence of the first and second level during the first period of time and to generate the activation signal only with the first level during the second period of time.

14. The electric driver circuit as claimed in claim 13, wherein, in the active state, the activation circuit is configured to generate the alternate sequence of the first and second level of the activation signal such that the time of first level of the activation signal is increased and the time of the second level of the activation signal is kept constant during the first period of time.

15. The electric driver circuit as claimed in claim 12, wherein, in the inactive state, the activation circuit is configured to generate the activation signal only with the second level.

* * * * *